United States Patent [19]

Tsai

[11] 4,197,599

[45] Apr. 15, 1980

[54] WATER-SAVING TOILET BOWL

[76] Inventor: Kuo L. Tsai, No. 106, Yung Chen Rd., Yung Ho Chen, Taipei, Hsien, Taiwan

[21] Appl. No.: 966,580

[22] Filed: Dec. 5, 1978

[51] Int. Cl.[2] ..... E03D 11/02; E03D 11/18

[52] U.S. Cl. ..... 4/424; 4/415; 4/420

[58] Field of Search ..... 4/424, 426, 425, 423, 4/415

[56] References Cited

U.S. PATENT DOCUMENTS

| | | | |
|---|---|---|---|
| 372,199 | 10/1887 | Boyle | 4/424 |
| 534,689 | 2/1895 | Hamilton | 4/424 X |
| 567,120 | 9/1896 | Fowler | 4/424 |
| 1,062,413 | 5/1913 | Payne | 4/424 |
| 1,988,234 | 1/1935 | Brain | 4/425 |
| 1,998,861 | 4/1935 | Campus | 4/425 |
| 2,212,538 | 8/1940 | Groeniger | 4/425 |
| 3,060,452 | 10/1962 | Dundy | 4/424 |
| 3,843,978 | 10/1974 | Ragot | 4/425 |

FOREIGN PATENT DOCUMENTS

| | | | |
|---|---|---|---|
| 683975 | 12/1952 | United Kingdom | 4/424 |

*Primary Examiner*—Henry K. Artis

*Attorney, Agent, or Firm*—Shoemaker and Mattare, Ltd.

[57] ABSTRACT

The present invention is related to a water-saving toilet bowl wherein the main flush inlet and secondary flush inlets are improved whereby the secondary flush enters into the upper reservoir later than the main flush; and in addition, the guiding plate between the upper reservoir and lower reservoir is prolonged to increase the acceleration of gravity; having the features that no more than six liters of water is required to flush away the defecation or the like.

3 Claims, 3 Drawing Figures

WATER-SAVING TOILET BOWL

BACKGROUND OF THE INVENTION

The present invention is related to a water-saving toilet bowl, particularly to a toilet bowl wherein the main flush inlet is large and declined toward the upper reservoir and is generally transversely tapered in the direction of the whirlpool made by the secondary flush; a weir is provided in the vicinity of the tapered main flush inlet to constitute a secondary flush entrance; the secondary flush inlets are declined toward the inner portions of the toilet bowl, and are decreased in number so that the secondary flush is decreased in flow quantity and enters into the upper reservoir later than the main flush; the upper reservoir is lifted somewhat to prolong the guiding plate between the lower reservior and the front end of the upper reservoir whereby the acceleration of gravity is increased; a guiding slot is provided at the bottom of the upper reservoir; having the features that firstly the main flush enters into the upper reservoir, and later on the secondary flush enters to form a whirlpool which mixes with it, flushing the waste away therefrom along the guiding trough and further along the guiding plate with the acceleration of gravity.

The main flush inlet of the conventional toilet bowls is small and is rectangular in cross section, and is generally vertical. Therefore the amount of flushing water is comparatively small, and since the water flushes along the rear wall of the toilet bowl, the resistance result in lowering the effect of flushing. Also, sir ~e the secondary flush inlets of the conventional toilet are many in number and are constructed in such a way so that the secondary flush in more than one direction simultaneously with the main flush, the secondary flush only lowers the effect of the main flush. In addition, the conventional bowls have the drawback that at the beginning of the flush, the waste is not immediately removed, and requires additional water to flush it away.

There is an improved water closet which also aims at saving the water. This improved water closet is characterized by two flushing systems, one requiring a large quantity of water to flush away solid waste and the alternate using a smaller amount to flush away liquid waste. However, except for the alternative amounts of water used, no other original concept has been incorporated. In the present invention, the improvement is in the toilet bowl itself.

SUMMARY OF THE INVENTION

The object of the present invention is to provide a water-saving toilet bowl wherein a guiding trough is provided to flush the waste away more easily.

Another object of the present invention is to provide a water saving toilet bowl wherein the guiding plate between the lower reservoir and the front end of the upper reservoir is prolonged to increase the acceleration of gravity in flushing.

Still another object of the present invention is to provide a water-saving toilet bowl wherein the secondary flush enters into the upper reservoir later than the main flush, obviating the possibility that the waste may linger within the upper reservoir.

BRIEF DESCRIPTION OF THE DRAWINGS

The above and other objects, advantages, and features of the present invention will become more readily understood from a consideration of the following detailed description and accompanying drawings, in which.

DETAILED DESCRIPTION OF THE DRAWINGS

Figure 1:
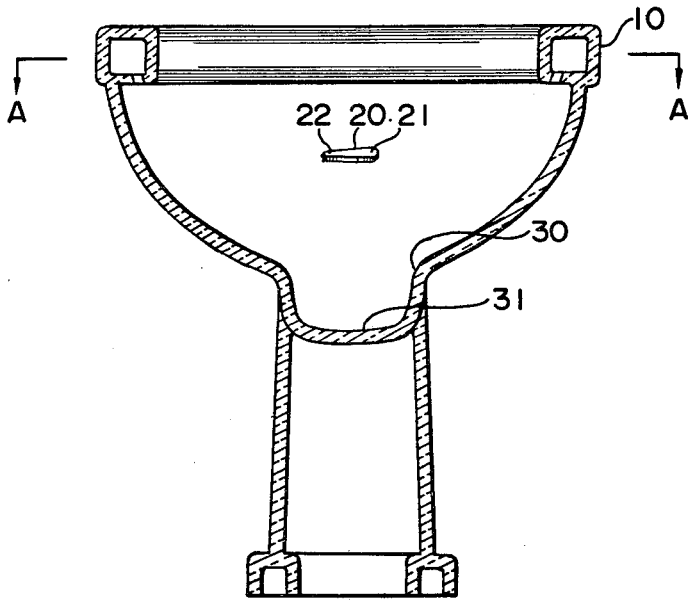
FIG. 1 is a vertical section of a preferred form of the water-saving toilet bowl, taken from the rear portion thereof.
Figure 2:
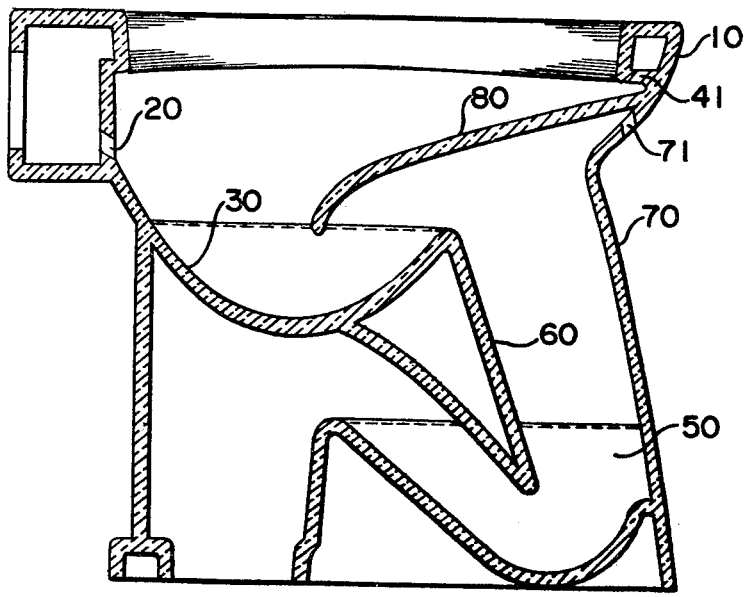
FIG. 2 is a vertical section of a preferred form of the water-saving toilet bowl, taken from one side thereof.
Figure 3:
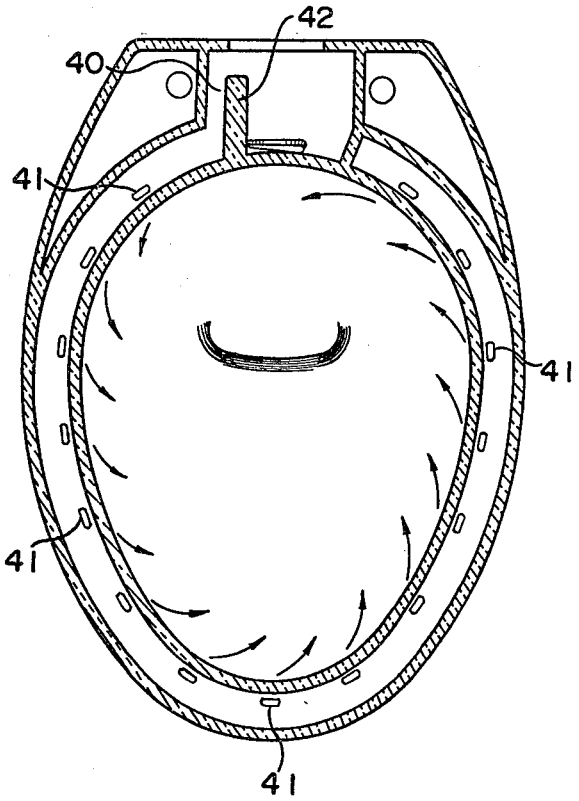
FIG. 3 is a cross section of a preferred form of the water-saving toilet bowl, taken on lines A—A of FIG. 1.

As shown, a large main flush inlet 20 is provided at the rear portion of the water-saving bowl 10. As shown in FIGS. 1 and 3, the main flush inlet 20 has two ends, the larger one being referred as 21 and the smaller one as 22. As shown in FIG. 2, the main flush inlet is declined whereby the main flush enters into the center of the upper reservoir 30 without passing along the rear surface thereof. Referring to FIG. 3, a weir 42 is provided at the left of the main flush inlet 20 to constitute a secondary flush entrance 40 and a plurality of secondary flush inlets 41—41 are provided around the rim of the toilet bowl.

The passage for secondary flush has one end free, i.e. said secondary flush entrance 40, and one end closed. Also referring to FIG. 3, the secondary flush inlets are declined counterclockwise to form a counterclockwise whirlpool, the smaller end 22 of the main flush inlet 20 turns to the left and the weir 42 is provided at the left of the main flush inlet 20. Whereas in a case where the secondary flush outlets are declined clockwise to form a clockwise whirlpool, it is otherwise so constructed that the small end 22 of the main flush inlet 20 turns to the right and the weir 42 is provided at the right of the small end 22 of the main flush inlet 20. The cross section of each secondary flush inlet 41 preferably presents a rectangular form. And furthermore, the secondary flush outlets are decreased in number so that the secondary flush enters into the upper reservoir 30 later than the main flush.

As indicated in FIG. 2, a guiding plate 60 is provided between the upper reservoir 30 and a lower reservoir 50, said guiding plate 60 being smoothly declined. To attain a desired acceleration of gravity, the upper reservoir 30 suspends high above the lower reservoir 50. In addition, the width between the front edge of the upper reservoir 30 and the upper portion of the water-passage wall 70 is widened to the extent that the water flushing down from the upper reservoir 30 would not flush against the upper portion of the water passage wall 70. Referring to FIG. 2, in an embodiment of the water-saving toilet, the front plate 80 extends into the water within the upper reservoir 30. And, at the uppermost portion of the water passage wall 70 under the front plate 80, an air vent 71 is provided. Furthermore, at the bottom of the upper reservoir 30 there is provided a guide trough 31 whereby the waste flushed by the main flush can readily flow along the guiding trough 31 and then away from the upper reservoir, preventing the lingering of the waste therein.

The main flush first enters into the upper reservoir 30, and then the secondary flush in the form of a clockwise or counterclock whirlpool to mix therewith, flushing the waste away therefrom along the guiding trough 31 and further along the guiding plate 60 with an acceleration of gravity.

It is an embodiment of the water-saving toilet bowl wherein the front plate 80 extends to the point just below the surface of the water of the upper reservoir 30.

However, there is another embodiment of the water-saving toilet bowl wherein the front plate 80 suspends above the water surface of the upper reservoir 30. In this case, no air vent is provided at the uppermost portion of the water-passage wall 70.

I claim:

1. A water-saving toilet bowl comprising:

a bowl having an upper reservoir defined therein;

a flush-water inlet means mounted on said bowl;

a main flush inlet defined in said flush-water inlet means to conduct flush-water into said bowl, said main flush inlet being tapered in cross-section so that said inlet has one end narrow with respect to another end thereof, said flush inlet being oriented at an angle with respect to the wall of said bowl to conduct flush water toward the center of said bowl in a stream which does not contact the wall surface of said bowl adjacent said flush-water inlet means;

a weir positioned in said flush-water inlet means adjacent said main flush inlet narrow end;

a secondary flush means surrounding said bowl, said secondary flush means having a secondary flush passage with one end thereof being in fluid communication with said flush-water inlet means to receive flush-water therefrom, said weir extending across said secondary flush passage one end so that flush water must pass over said weir to enter said secondary flush passage, said secondary flush passage having another end thereof closed;

a plurality of secondary flush inlets defined in said secondary flush passage, each secondary flush inlet being declined in the same direction as said main flush inlet narrow end and being oriented to initiate a whirlpool along an inside surface of said bowl;

a lower reservoir defining means positioned beneath said bowl and defining a lower reservoir;

a water-passage defining means defining a water passage fluidly connecting said upper reservoir to said lower reservoir and including a guiding plate which is to be contacted by water as that water moves from said upper reservoir to said lower reservoir, and a water-passage wall;

a front plate connected at one end thereof to said water-passage wall and extending away from said water-passage wall over the surface of water contained in said upper reservoir, and having a free end presented toward said main flush inlet;

an air vent defined in an upper portion of said water-passage wall;

said weir delaying movement of flush water into said secondary flush passage so that a main flush enters said upper reservoir via said main flush inlet prior to initiation of a secondary flush via said secondary flush inlet means, said declined orientation of said secondary flush inlet means directing said secondary flush in the form of a whirlpool to mix with said main flush to flush waste through said water passage into said lower reservoir; and disposal means connected to said lower reservoir for disposing of flush water from said lower reservoir.

2. A water-saving toilet according to claim 1 wherein said front plate free end is located at a point just below the surface of water of said reservoir.

3. A water-saving toilet bowl according to claim 1 wherein a guiding trough is defined in the bottom of said upper reservoir.

* * * * *